United States Patent [19]

Schiemann

[11] Patent Number: 4,730,747

[45] Date of Patent: Mar. 15, 1988

[54] SCREW STOPPER FOR SYNTHETIC PLASTICS MATERIAL CANS

[76] Inventor: Wolfram Schiemann, Eugen-Nagele-Str. 17, 7140 Ludwigsburg, Fed. Rep. of Germany

[21] Appl. No.: 17,540

[22] Filed: Feb. 24, 1987

[51] Int. Cl.[4] ..... B65D 41/04

[52] U.S. Cl. ..... 220/288; 220/264; 220/263

[58] Field of Search ..... 220/288, 263, 264, 318; 222/469

[56] References Cited

U.S. PATENT DOCUMENTS 4,099,642 7/1978 Nergard ..... 220/264

4,624,385 11/1986 Yano ..... 220/264

*Primary Examiner*—George T. Hall

[57] ABSTRACT

A screw stopper for synthetic plastic cans in the range of 10 litres and above has a pouring spout with an external threading, a cap with an internal threading fitting the external threading on the pouring spout, and a connection device between the pouring spout and the cap. The external and internal threadings have an equal pitch, that is high enough that rotation of the cap through 180 degrees plus/minus 30 degrees rotates the cap from a closed to an open position. An articulated handle on the upper side of the cap protrudes far beyond the cap. The connection device includes a retaining ring that guides the cap in a shape-engaging manner and a guide device that is rigidly connected with the pouring spout and guides the retaining ring and has a partial region arranged as an arrestor for the handle grip in the closed position of the cap.

23 Claims, 19 Drawing Figures

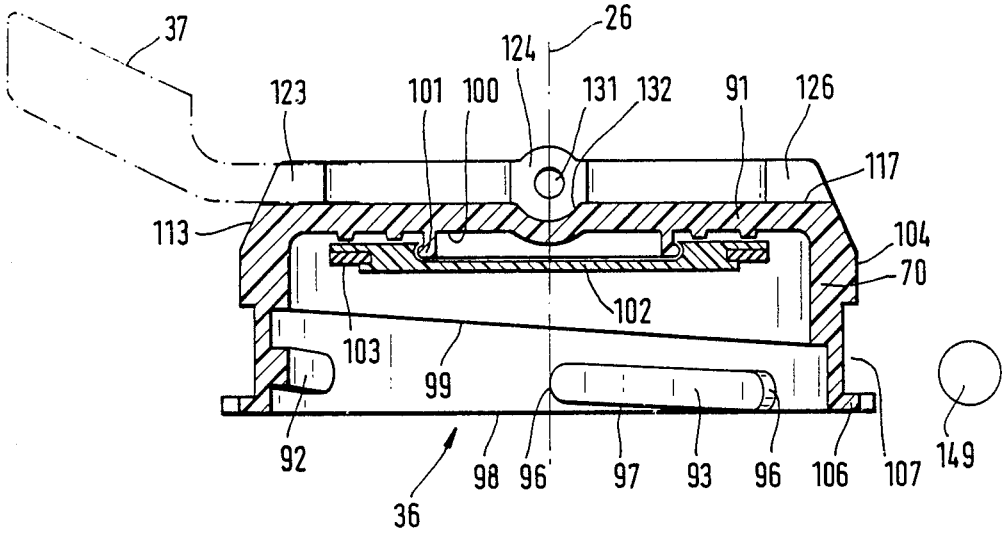
FIG. 11
FIG. 12
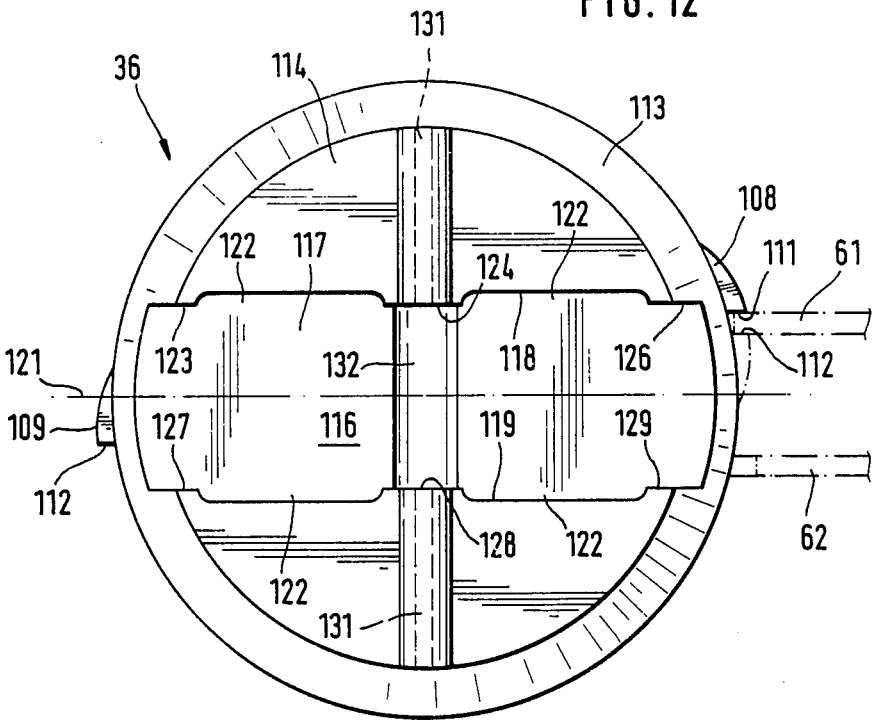

SCREW STOPPER FOR SYNTHETIC PLASTICS MATERIAL CANS

The invention relates to a screw stopper, and more particularly, a screw stopper for synthetic plastic cans in the range of 10 liters and above.

Such screw stoppers have a pouring spout which is rigidly connected with the synthetic plastic can. The pouring spout has a geometric longitudinal axis, an external threading, and an end face with annular seal thereon.

The pouring spout also has a cap, which is rotatable between a closed position and an open position. The cap has an external circumference and an internal threading fitting the external threading on the pouring spout.

A projecting device projects from the external circumference of the cap for manual transmission of a torque, and a connection device is provided between the pouring spout and the cap, which makes the cap non-loseable and permits rotation of the cap in relation to the pouring spout.

Screw stoppers of this kind must satisfy very strict conditions. With the can filled they must be capable of falling with the stopper foremost on to hard ground, without the stopper then leaking. This applies to heights of 1.80 meters and at temperatures reaching from −30 degrees C. to +60 degrees C.

Furthermore, the opening and closing mechanism must be such that everyone understands it without instruction, even for example at night, without having to look exactly, or even when rational thinking is absent, as for example, in panic situations.

The known claw-type stoppers have the advantage that it is clearly visible even for the laymen when the can is closed and when it is open. However, whenever these claw-type stoppers have been used together with can of synthetic plastic material, reinforcing constructions of metal have always been necessary which through special design features have introduced the forces acting upon the pouring spout into the synthetic plastics material can.

Screw stoppers are cheaper than the claw-type stoppers. However, these have a series of disadvantages:

(a) With them, one neither sees or can feel, in poor visibility, whether the can is closed. Even with great technical understanding one cannot see whether the stopper has been tightened with the necessary moment.

(b) Both in tightening and in opening one must change one's hand grip about six times before one has reached the open or the closed condition. This is fatiguing and also takes much too long in emergency situations. In this connection it is not to be presumed that only one single can is to be opened or closed. Rather sometimes whole lorry-loads have to be emptied and refilled.

(c) So that the necessary closing moment may be achieved even with weak hands, the pitch of the threading must be relatively small. This signifies rather a fine threading than a course threading, which makes the tool dearer.

(d) In the case of a threading tending more towards the fine, the root area of the thread turn is relatively small, so that the thread turn can flow away, as is typical for blow-moulded synthetic plastics materials.

(e) The cap hangs on a kind of synthetic plastics strap. The synthetic plastics strap must be relatively long so that the cap can reliably come out of the poured jet. The substantially better positioning of the pouring cap, to which one is accustomed for example from claw-type stoppers, cannot be achieved thus. Thus the cap swings to and fro.

(f) The synthetic plastics strap also hinders the turning of the cap, for one can turn only as far as the synthetic plastics strap and then the hand must be moved back.

(g) The synthetic plastics strap is secured rotatably centrally on the top of the cap. In rotation of the synthetic plastics cap this region of the connection device seeks to accompany the rotation. In fact two hands are needed: with the one one rotates the synthetic plastics cap and with the other one holds back the connection device. However the second hand would be required here to hold the can fast.

(h) So that the cap can swing out of the way in the opened condition, the synthetic plastics strap must be relatively thin. Therefore it frequently also breaks off and the cap is then only theoretically non-losable.

(i) On account of the long turning distance of the cap the press-on sealing plate, always present on the inside, chafes causing abrasion.

(j) Since relatively many thread turns are necessary, the invariably present spout integral with the synthetic plastics can must be relatively long. If the spout is long the entire stopper is of high formation, and if the stopper is high, then in the case of stackable synthetic plastics cans it comes above the stacking level, so that the synthetic plastics cans no longer stand one upon the other correctly.

(k) Since the spout integral with the can must be relatively long one is compelled to cause it to extend more perpendicularly than would be desirable for convenient pouring, so that the screw cap does not extend into the stacking plane.

It is the problem of the invention to indicate a screw stopper which avoids the above-stated disadvantages as a whole but is in fact practible under the conditions of use such as can occur in the worst case, even in emergencies.

In accordance with the invention, this problem is solved by the following features:

(a) The external threading on the pouring spout is provided in three or more sectors in relation to the geometrical longitudinal axis of the spouring spout.

(b) The internal threading on the cap is provided in three or more sectors in relation to the geometrical longitudinal axis of the pouring spout, with the internal threading sectors fitting in circumferential angle into the external threading sectors on the pouring spout and vice versa.

(c) The internal and external threadings have equal pitch, which pitch is high enough that rotation of the cap through 180 degrees plus/minus 30 degrees rotates the cap from its closed position to its open position and vice versa.

(d) The cap has an upper side, and the projecting device comprises a handle on the upper side of the cap, which is provided with a handle grip that protrudes far beyond the external circumference of the cap and a handle web with an end region pivotably articulated with the cap.

(e) The connection device includes a retaining ring which guides the cap in a shape-engaging manner and a guide device that is rigidly connected with the pouring spout and guides the retaining ring substantially nonrotatably in relation to the geometrical longitudinal axis of the pouring spout.

(f) The guide device has a partial region arranged as an arrestor for the handle grip in the closed position of the cap.

Thus the following advantages are combined:

(a) The pitch of the threading can be large and nevertheless the cap does not open itself.

(b) The thread root can be extraordinarily wide.

(c) Production can be simple since continuing thread turns do not have to be produced.

(d) One sees immediately whether the cap is open or shut, for there are only two extraordinary and also easily recognizable positions of the cap. The one position cannot be confused with the other.

(e) The handle considerably increases the applicable moment, even beyond what is ordinarily applied for the transmission of the torque, namely a roughly radial structure.

(f) Closing and opening proceed just as quickly as with the known claw-type stopper.

(g) When the handle grip is arrested, the cap is closed, namely neither with too much force, which would cause overstressing, nor with too little force which would cause leakage.

Advantageously, the invention includes the following additional features:

Three sectors of the external threading and the internal threading are provided. Rotation of the cap through 180 degrees rotates the cap between the closed and open positions.

By these features, one achieves a minimum number of sectors together with an easily visible or even feelable position of the cap.

The sectors of the external threading are of equal length and arranged at angularly regular intervals. By this feature, the production is simplified and the engagement lengths of the sectors remain uniformly observable.

The sectors are longer than 45 degrees and shorter than 60 degrees. By this feature, one obtains sectors which are long but not too long, which guide the cap wall on its short rotation distance.

The can has a spout extension integral with the can, and the external threading is part of an annular, injection-molded body which firmly and rigidly-abuttingly girdles the spout extension. By these features, one can apply the invention even to those synthetic plastics material cans in the production of which the synthetic plastics material is subjected only to low pressures, as for example, the centrifugal casting process, blow-molding, etc. In these cans the spout extension is comparatively soft, while the injection-molded body can be nearly as hard as light metal. Moreover, this reduces the weight of the synthetic plastics can, the great advantage of which is per se its low weight compared with a sheet metal can, which would be partialy increased by a metallic body. This is important especially for cans which are transported as air freight. Moreover, an injection-molded body can be produced with more precise dimensions than would be the case with other methods.

The cap and the connection device are injection-molded from synthetic plastic. Logically, the same advantages as described above arise from this feature.

The handle web has a width of at least one-fifth of the external diameter of the cap. Due to this feature, the lateral bending of the handle web can be neglected and the forces can be introduced into the cap at mutually relatively remote points.

The handle web has a width 3.5 plus/minus 15% smaller than the external diameter of the cap. Due to this feature, the handle web is not too large and has an optimum value in relation to the size of the cap.

The handle web is flat in relation to its width. Due to this feature, the handle web is inconspicuous in height.

The cap has a transverse axis and the handle web has a free end zone that is pivotable through 180 degrees about the transverse axis. Due to these features, the optimum lever arm is obtained in the two end positions.

Perpendicularly of the transverse axis, the upper side of the cap has a shallow groove that accommodates the handle web in width and height. Due to this feature, the handle web remains protected.

The handle web has side faces and the groove has side walls, and, at least in partial zones, the side faces of the handle web rest on the side walls of the groove. Due to these features, the forces occurring in closing and opening are introduced not only in the region of the transverse axis but also in these partial zones which can lie relatively far outwards, so that favorable force conditions occur.

The can has carrying handles with upper sides and the handle grip has an upper side that, in a closed condition, lies at the level of the upper sides of the carrying handles and is angled in relation to the handle web. Due to these features, further standing area can be gained in stacking. Moreover, an article lying thereabove, for example a further can, additionally secures the handle grip in the arresting direction.

The handle grip has a hollow portion on its under side, which engages the partial region of the guide device. Due to this feature, material is saved, the handle grip can be made relatively large without the occurrence of material retractions and the hollow regions can be used at the same time for position fixing in rotation.

The partial region of the guide device is also a security means against rotation for the handle grip. Due to this feature, the cap can no longer open of its own accord, despite the fact that the pitch of the threading is relatively high.

The guide device has webs, and when the handle grip is arrested by the guide device, it sits against the webs. Due to these features, the forces acting upon the handle grip, for example in stacking, can be introduced in a simple way into the pouring spout.

The retaining ring has a shank zone, and the guide device comprises two mutually parallel, mutually spaced, walls parallel to the geometrical longitudinal axis of the pouring spout, the walls having interior machined depressions that guide the shank zone between them. Due to these features, a protected guidance is obtained, namely for the cap rising and descending in opening and closing, for the pivoting of the cap and also for the holding of the cap in the open position, in which, as is known, it must not drop into the pouring jet.

The shank zone comprises two lugs bent out of the retaining ring and guided on the parallel walls of the guide device. By this feature, one obtains a one-piece junction, which can well be injection-molded, between the retaining ring and the guide device.

A distance piece is provided which provides a spacing member for the lugs and grasps around the lus. Due to this feature, the inherently thin lugs become easily connectable with one another, the retaining ring can easily be fitted by slight bending open, and also the lugs then cannot be pressed together.

The retaining ring has a flat profile in cross-section and is circular-cylindrical, and the external circumference of the cap has a matching groove in which the retaining ring is guided. Due to these features, a wide guide surface and a rigid retaining ring are obtained, which retaining ring can take up high forces and retain its shape even if overloading occurs.

On the external circumference of the cap, at least one projection is provided which abuts the guide device in the closed position and/or the open position. Due to this feature, the cap cannot be turned beyond its two illustrated positions.

The projection is provided beneath the retaining ring. By this feature, the object is achieved that the projection is in a position where it causes no interference, and moreover, there it comes early into the region of the guide device, which would not be the case if it were to lie, for example, above the retaining ring.

DESCRIPTION OF THE DRAWINGS

A preferred example of embodiment of the invention will be described below.

FIG. 11 shows a radial section through the closure cap on the scale 1:1, FIG. 12 shows the plan view of FIG. 11.

DETAILED DESCRIPTION

Figure 1:
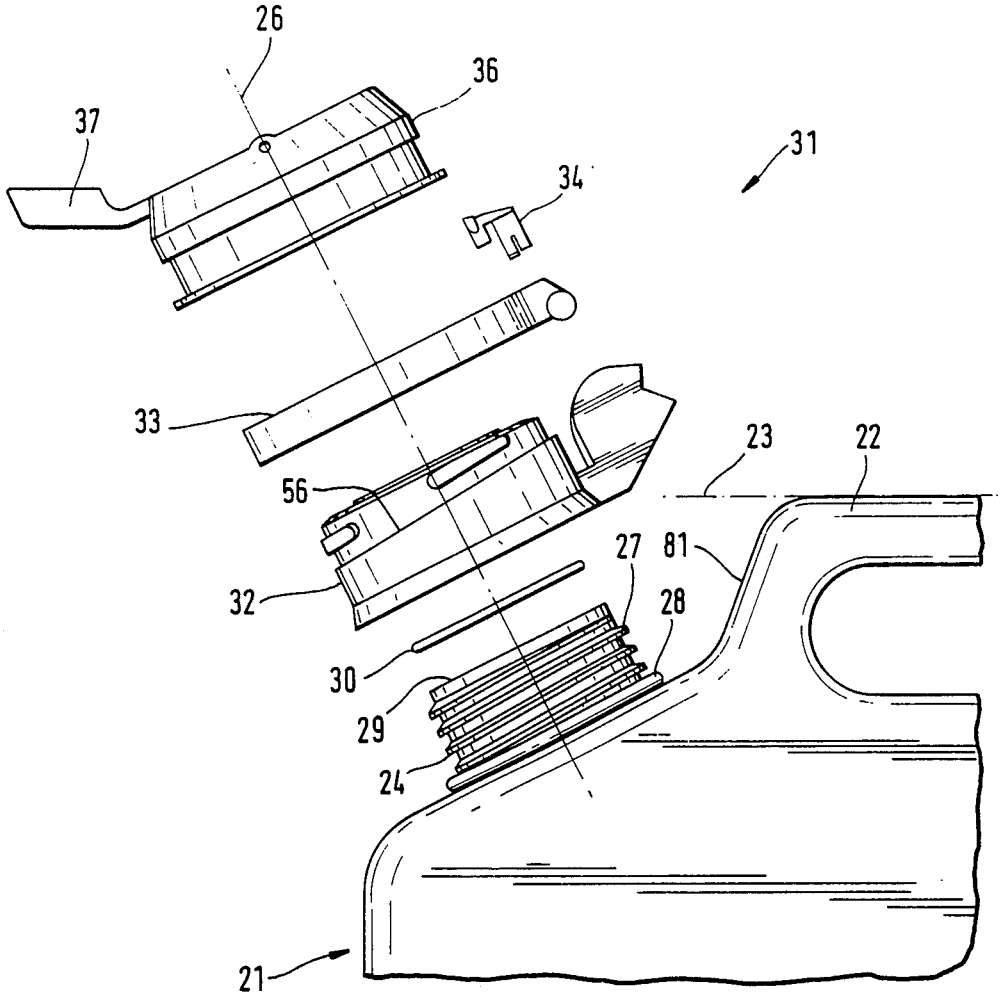
FIG. 1 shows an exploded illustration of the screw stopper with the upper left region of the can.

A 20-liter can 21 is blow-moulded from synthetic plastics material in the usual way. On its upper side it has three handles 22, the upper sides 23 of which extend parallel with the bottom (not shown) of the can. To the lower left of the handles a spout extension 24 is provided integrally with the can 21 and is coaxial with a geometrical longitudinal axis 26 extending obliquely in the manner as illustrated. Externally the spout extension 24 carries a coarse external threading 27. At the base of the external threading 27 an O-ring 28 is provided, which has sealing functions. On the end face 29 of the spout extension 24 there lies an O-ring 30 likewise having sealing functions.

A closure 31 comprises a pouring spout 32, a retaining ring 33, a distance piece 34, a cap 36 and a handle 37. Apart from the distance piece 34 and the handle 37, these parts lie coaxially with the geometrical longitudinal axis 26, namely when the closure 31 is closed, in the opening movement and also until the moment when the cap 36 is pivoted up.

Figure 2:
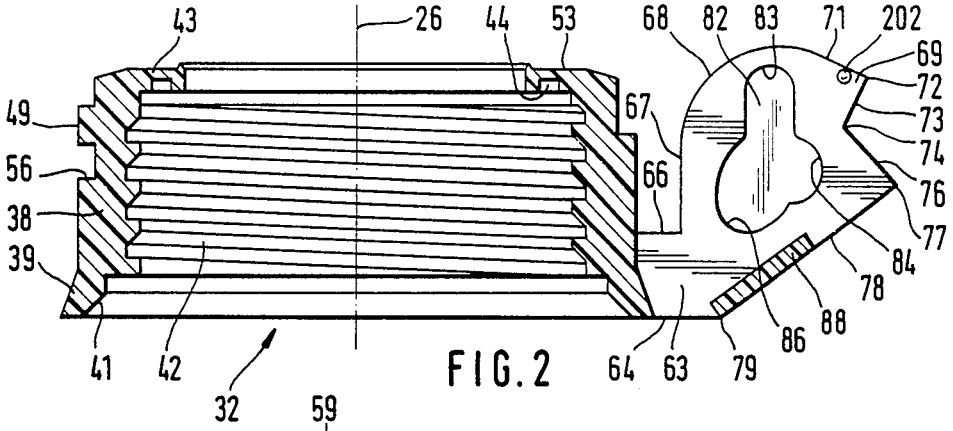
FIG. 2 shows a radial section through the pouring spout.

The pouring spout 32 (FIGS. 2 to 4) has a substantially cylindrical wall 38. Downwards this merges into a small, widening cone frustum 39. The inner slope 41 of the latter presses in wedge form upon the O-ring 28 and thus forms a first seal. The inner wall carries a coarse internal threading 42 which can be screwed on to the external threading 27. At the top the wall 38 merges into a small, inwardly directed cover ring 43, which has on the under side a ring groove 44 in which the O-ring 30 lies. The contributory dimensions are such that the inner slope 41 rests with the necessary force on the O-ring 28 precisely when the cover ring 43 presses the O-ring 30 with the correct force upon the end face 29. Moreover then a guide device 46 (FIG. 3), to be explained later, has a position in which it is symmetrical in relation to the central plane 47 of the 20-1. can 21. On the outside the wall 38 carries three sectors 48, 49, 51 which have a roughly rectangular profile and each have roundings 52 at their ends. Their rise amounts to 14 mm. As appears especially clearly from FIG. 4, the sectors 48, 49, 51 are a single but interrupted thread turn, where the sector 51 begins with the upper side 53 of the cover ring 43 at 54, then descends, continues later in the sector 49 lying at half height which then in turn continues with the lowest sector 48. Calculating in the clockwise direction in FIG. 3 from the central plane 47, the sector 51 begins at 35° and ends at 90°. The sector 49 begins at 145° and ends at 215° and the sector 48 begins at 270° and ends at 325°. The sector 48 does not actually end at 325°; rather its upper side continues with the spiral surface 56 visible in FIG. 4, so that (FIG. 4) beneath the sector 48 a recess occurs which has its end at 57. Thus in the view in FIG. 3 an empty sector 58 results between the sector 51 and the sector 49, and an empty sector 59 results between the sectors 49 and 48.

No empty sector results between the chain line at 67 and the sector 51, because thence the spiral surface 56 swings away and an empty sector is not necessary there for the function.

The guide device 46 includes two walls 61, 62. Regarding their arrangement, form and configuration reference is made expressly to FIGS. 2 to 4, which are to scale. According to these the wall 61 comprises a part wall 63 standing horizontally to the right according to FIG. 2, the lower edge 64 of which extends horizontally at the level of the lower edge of the cone frustum 39. The upper horizontal edge 66 extends approximately at one third of the height of the pouring spout 32 and then merges into a vertical edge 67 which merges, approximately at the level of the spiral surface 56 there, into a quarter circle 68 pointing to the right. The quarter circle 68 is continued to the right in a spur 69 which has at the top an edge 71 inclined at 25° to the horizontal. Thereupon a sharp point 72 follows. The point 72 is followed by a straight edge 73 swinging away downwards to the left at about 60°, which after a corner 74 merges into a straight abutment edge 76, which swings away down to the right. The edge 72 is shorter than the stop edge 76, as the drawing shows. After an 80° corner 77 there follows a straight lower edge 78 which has an angle of about 35° and merges with a corner 79 into the lower edge 64. As also appears from FIG. 1, the lower edge 79 has approximately the angle in relation to the geometrical longitudinal axis 26 which the plane 81 assumes the spout extension 24 towards the upper side 23. However in the assembled condition a distance remains between the lower edge 78 and the plane 81. From the inner side of the wall 61 a shallow milled recess 82, not piercing the wall, is provided which according to the drawing comprises an upwardly extending round inlet 83, a shorter but also wider round inlet 84 extending towards the 80° corner 77, and a likewise shorter but wide round inlet 86 extending towards the partial wall 63. The edges of these inlets have a considerable spacing from the outline of the wall 61.

Figure 3:
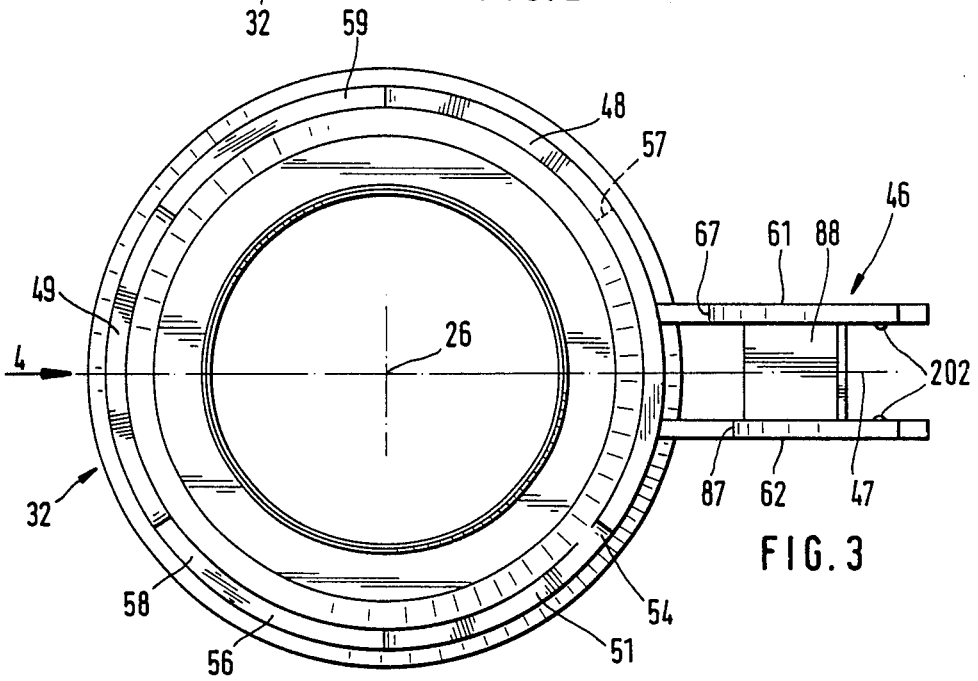
FIG. 3 shows the plan view of FIG. 2.
Figure 4:
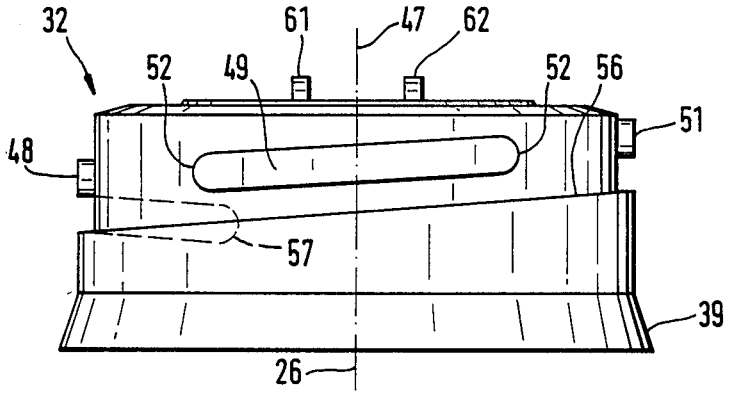
FIG. 4 shows a view in the direction of the arrow 4 in FIG. 3, FIGS. 2-4 being on the scale 1:1.

The wall 62 is in mirror image about the central plane 47, with the one exception that according to FIG. 3 its vertical edge 87 is more remote from the pouring spout 32 than is the vertical edge 67.

In the region of the lower edge 78 the two walls 61, 62 are connected with one another by a flat stiffening crosspiece 88. So that the pouring spout 32 cannot rotate on the spout extension 24, a snap-locking device (not shown) is provided which acts in a manner in which an elevation provided at the bottom of the cone frustum 39 can snap into a corresponding depression of the plane 81.

Figure 13:
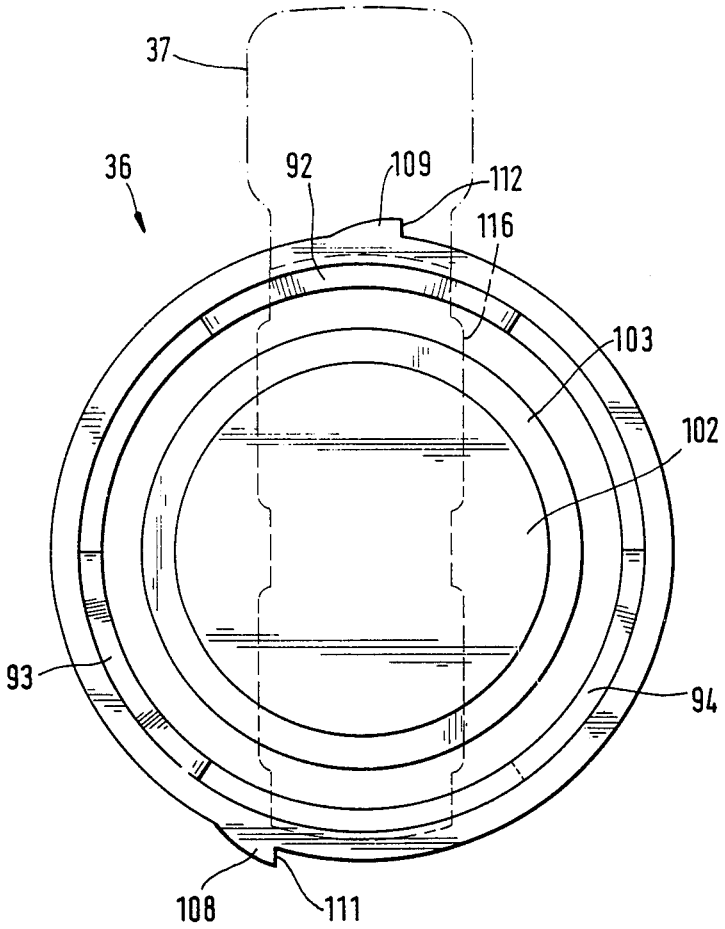
FIG. 13 shows the view of FIG. 11 from beneath.

The cap 36 (FIGS. 11 to 13) has a substantially circular-cylindrical wall 70 coaxial with the geometrical longitudinal axis 26. This wall merges at the top into a cap top 91. Where according to FIG. 3 the empty sectors 58, 59 are situated and in the space between the sector 61 and the chain line at 57, the wall 69 has on its inner side three sectors 92, 93, 94, which extend inwards, are in angle somewhat shorter than the empty sectors 58, 59, have roundings 96 at the ends and can be interpreted as a single interrupted thread turn with a rise of 14 mm., which in the closed condition engages beneath the sectors 48, 49, 51. The sector 93 merges with its under side 97 at the rounding 96 on the right in FIG. 11 into the lower edge 98 of the cap 36. Analogously with the spiral surface 56, here again one has a spiral surface 99. On the inner surface 100 of the cap top, extending downwards according to FIG. 11, a collar 101 is coaxially provided which with a snap connection holds a sealing plate 102, the elastic outer edge 103 of which presses on the upper side 53, in the closed condition.

According to FIG. 11 a circular-cylindrical, coaxial groove 107 is provided in the circular-cylindrical external circumference 104 far downwards, so that only a narrow wall 106 remains. The height of this groove is substantially greater than its depth. The wall 106 merges into two stop noses 108, 109 which, regarded absolutely and in relation to one another, have the angle position visible from FIG. 13. On their sides facing one another and lying downward according to FIG. 13 these have radial stop faces 111, 112. They protrude according to FIG. 12 so far that they can butt on the wall 61. In the fully closed condition the stop face 111 strikes according to FIG. 12 from above against the wall 61 and in the fully opened condition the stop face 112 strikes from beneath against the wall 61. They cannot stike upon the wall 62, because this recedes further, as shown by FIG. 12.

The external circumference 104 merges by way of a 25° slope 113, which is likewise coaxial, into a substantially plane upper side 114. Into this a shallow groove 116 is let which has a flat groove bottom 117 and groove side walls 118, 119 perpendicular thereto. The central plane 121 of the groove 116, and thus the groove itself, lies so that it is aligned with the central plane 47 of the can when the cap 36 is in its closed position or in its open position not yet pivoted up. The groove side walls 118, 119 have the recesses 122 visible from FIG. 12, in each case four in number, lying opposite to one another by pairs, so that mutually aligned protruding partial zones 123, 124, 126, 127, 128, 129 remain which lie opposite to one another by pairs and are aligned in the longitudinal direction in groups of three 123, 124, 126; 127, 128, 129. Quarter-cylindrical beads 131, 131 having an aligned through-passing bore are provided perpendicularly of the central plane 121 where the partial zones 124, 128 are situated. Beneath this through-passing bore 131, in the projection according to FIG. 11, the groove bottom 117 has a depression 132. An axially immovable spindle (not shown), which traverses the groove 116, is fitted in the through-passing bore 131.

Figure 5:
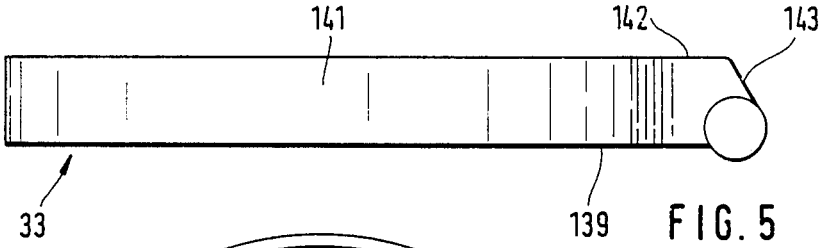
FIG. 5 shows the lateral view of the retaining ring.
Figure 6:
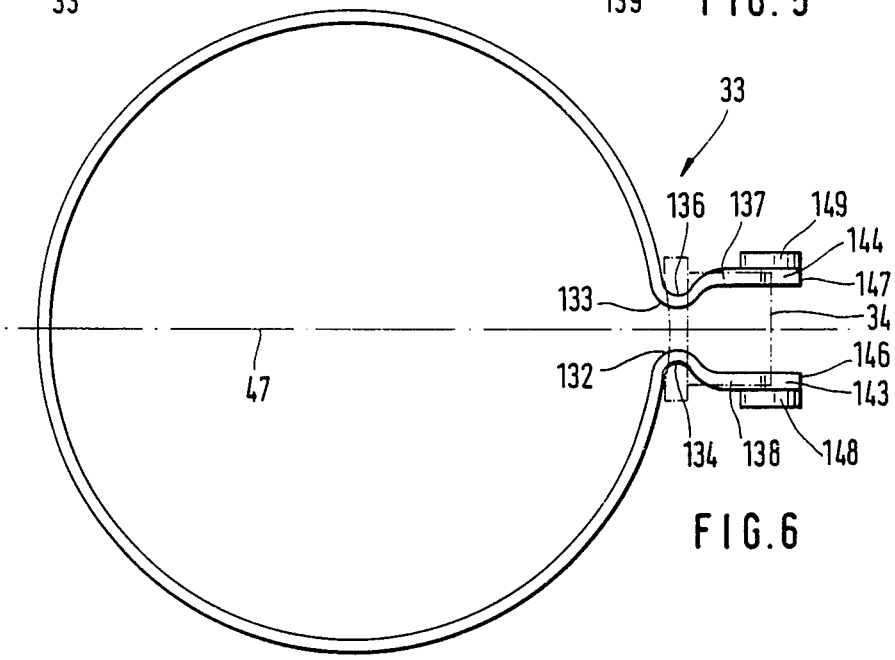
FIG. 6 shows the plan view of FIG. 5, on the scale 1:1.
Figure 7:
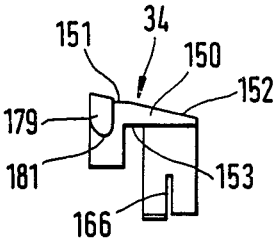
FIG. 7 shows the lateral view of the distance piece on the scale 1:1.
Figure 9:
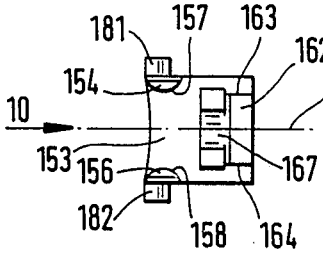
FIG. 9 shows the view of FIG. 7 from beneath.

According to FIGS. 5 and 6 the retaining ring 33 has an approximately annular configuration. It is so high that it fits in height into the groove 107 with slight play and it is so thin that it does not protrude from the groove 107. It has a distinct I-section. Its size is such that even when the distance piece 34 is fitted the cap 36 can be rotated in relation to the retaining ring 33. As FIG. 6 shows, the retaining ring has a uniform annular course except for about 10° and in the 10° zone has in each case a channel-shaped cranked-ff portion 132, 133 amounting to about 180°, which is just as wide as the rest of the retaining ring 33. The cranked portions 132, 133 each have externally a channel face 134, 136, which are accordingly semi-circular. At their right end zone in FIG. 6 the cranked portions 132, 133 merge into two lugs 137, 138 which are plane walls parallel with one another, lie parallel to the central plane 47, and have a lower edge 139, which is the continuation of the lower edge of the strip 141, the upper edge 142 of which is likewise - in the view in FIG. 5—the continuation of the upper edge of the strip 141, but after a short distance merges in each case into a straight slope 143, 144, which according to FIG. 5 drops away down to the right and by way of a somewhat downwardly protruding half-radius 146, 147 merges again into the lower edge 139. Reference is made expressly to FIGS. 5 and 6 regarding the precise form.

On their outwardly directed faces the half-radii 146, 147 merge into circular discs 148, 149 which are about 4 mm. in height. As part of the whole the disc 149 is intended in FIG. 11, so that from its position it is possible to deduce the position of the whole. In the finally assembled condition the discs 148, 149 lie in the milled recesses 182 of the walls 61, 62.

Figure 17:
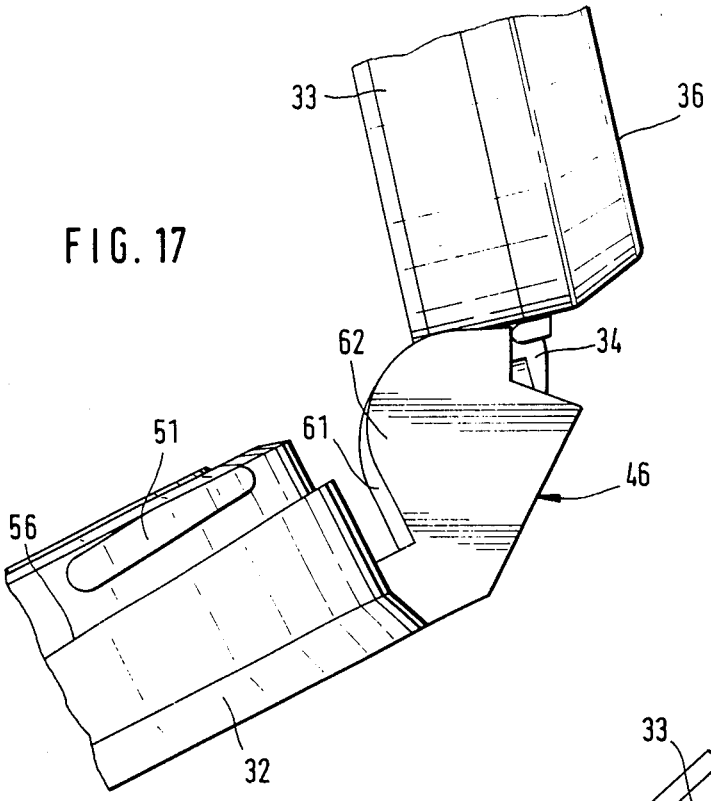
FIG. 17 shows the lateral view in the region of the guide device, the cap being arrested in the opened condition so that it cannot fall into a pouring jet.
Figure 18:
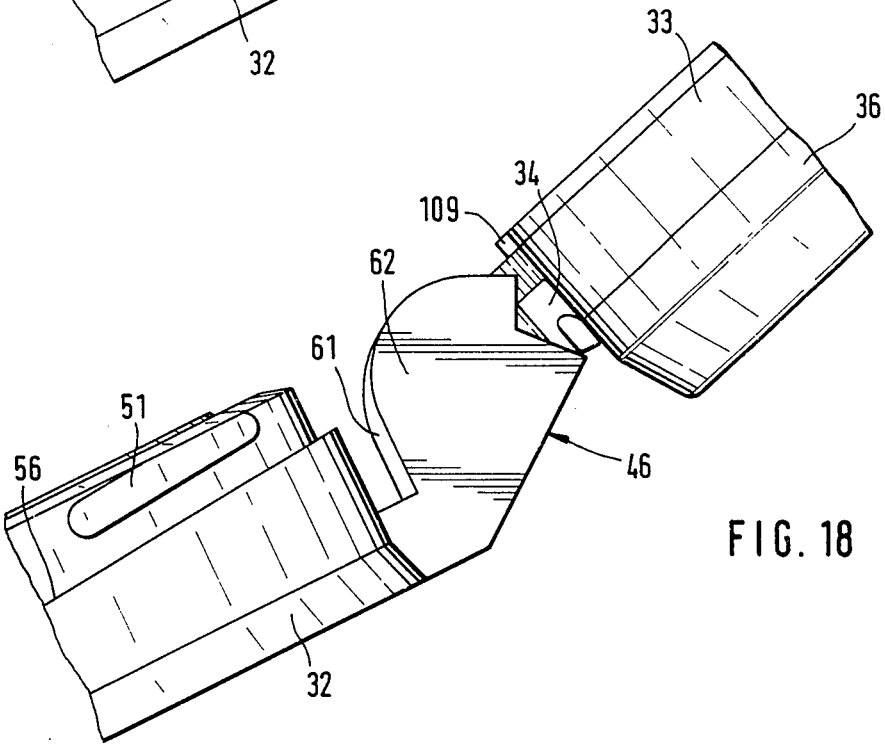
FIG. 18 shows a view of the region of FIG. 17, but with cap fully hinged up and thus not arrested.

The distance piece 34 according to FIGS. 7 to 10 prevents the lugs 137, 138 from opening out or being pressed together and renders it possible for the cap 36 to be opened fully for example according to FIG. 18 and also to be held according to FIG. 17 so that it does not drop into the pouring jet of the liquid from the can, that is it is not necessary to hold it fast separately.

The distance piece 34 is in one piece and injection-moulded from synthetic plastics material. It is symmetrical in relation to the central plane 47. It has a back plate 150 consisting of a narrow, plane, rectangular surface 151 with an inclined surface 152, and thus becomes ever thinner to the right in FIG. 7. The under side 153 is plane. In the view in FIG. 9 two pins 154, 156 issue upwards from its left corners, which have on the sides facing one another a semi-cylindrical surface 157, 158 each and are so arranged and shaped that the pin 154 in the fitted condition lies in the channel face 134 and the pin 156 lies in the channel face 136 and thus opening out is prevented. Inwardly and upwardly arranged slopes 159, 161 facilitate fitting on to the lugs 137, 138 in the appropriate regions. According to FIG. 9 a block 162 issues upwards from the upper side 153, of which block the side faces 163, 164, extending parallel to the central plane 47, abut on the inner side of the lugs 137, 138 and prevent these from coming too close to one another, which would involve the danger of the discs 148, 149 coming out of the recesses 82. Perpendicularly of the central plane 47 the block 162 has an incision 166 going to about mid height, which also divides it according to FIG. 7 in width. A U-shaped recess 167 also reaches as far as this incision 166 and together with the incision has the effect that two legs 168, 169 are produced which are springable towards one another but quite stiff. As shown especially by FIG. 7 these legs 168, 169 are somewhat longer than the remainder of the block 162, and there they carry outwardly extending barbs 171, 172 which according to FIG. 10 carry introduction ramps at top left and top right. The effective horizontal face of the barbs 171, 172 is so arranged that when the barbs just engage beneath the lower edge 139, the under side 153—in so far as its partial zones come into question for this purpose—lies on the upper edge 142. Thus the distance piece 34 can be fitted when the discs 148, 149 are lying in the recesses 82. Then in the position according to FIG. 6 the distance piece 34 is simply pushed on from above and then it lies on the upper edge 142, so far as the latter extends horizontally.

Figure 8:
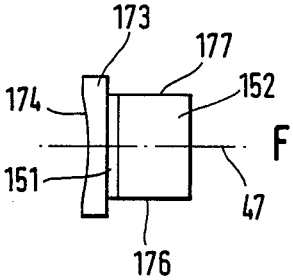
FIG. 8 shows the plan view of FIG. 7.
Figure 10:
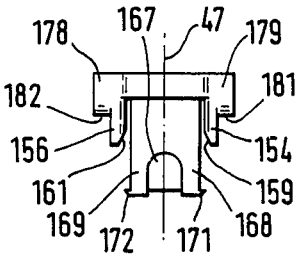
FIG. 10 shows the view in the direction of the arrow 10 in FIG. 9.

According to FIG. 8, to the left of the surface 151 a transverse locking member 173 is provided the left edge 174 of which in radius manner follows the external contour of the strip 141. The transverse locking member 173 protrudes according to FIG. 8 a little beyond the plane, mutually parallel side faces 176, 177, and there has the form of a projection 178, 179 which in the fitted condition and in the appropriate open position reaches into that aperture which is determined by the straight edge 73, the corner 74 and the stop edge 76. The projections 178, 179 are in alignment, to the left according to FIG. 7, with the edges there of the pins 154, 156. To the right according to FIG. 7 they are about half as wide and downward they have a doming 181. As FIG. 17 shows, the cap 36 does not tilt downwards, because the domings 181 rest on the straight edge 73 of each wall 61, 62 and at the same time the discs 148, 149 are situated in the round inlet 84 and then, on account of the tongue situated between it and the round inlet 83, cannot pass into the round inlet 83.

In the fully opened condition, that is for example with the can standing perpendicularly, the discs 148, 149 lie in the respective round inlet 83 and now according to FIG. 18 each projection 178, 179 lies on the pertinent stop edge 76 and thus cannot open further.

Figure 14:
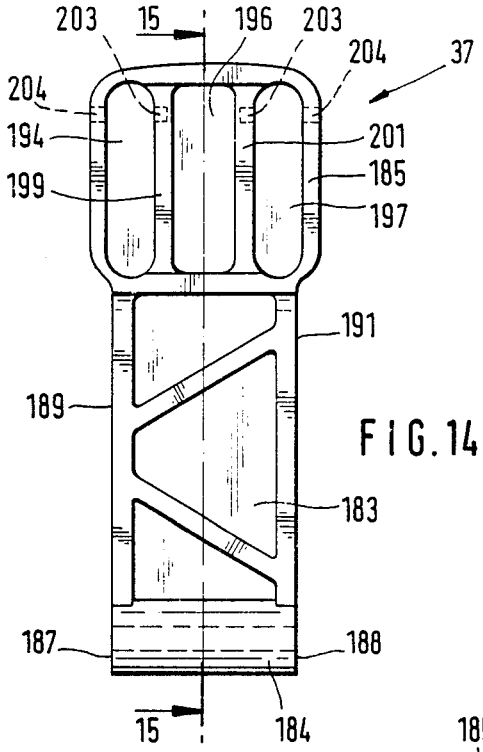
FIG. 14 shows the view of the handle from beneath on the scale 1:1.
Figure 15:
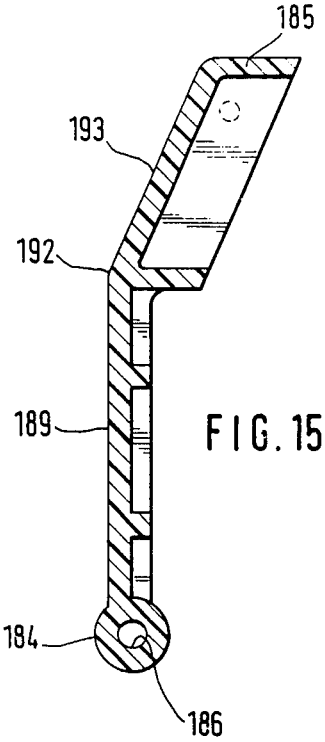
FIG. 15 shows a section along the line 15—15 in FIG. 14.
Figure 16:
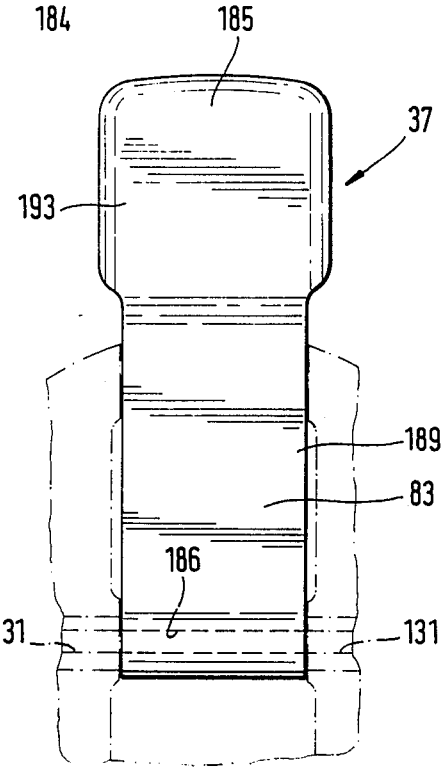
FIG. 16 shows the plan view of FIG. 14 with groove indicated.

The handle 37 as explained precisely in FIGS. 14 to 16 is injection-moulded from synthetic plastics material. It has a handle web 183 and a handle grip 185. Continuing in outline the elevation on the upper side 114 and the depression 132 the handle web 183 has a cylinder 184 on its lower end according to FIG. 14. The through-passing bore 186 thereof is aligned with the through-passing bore 131 and is traversed by the spindle (not shown). The end faces 187, 188 of the cylinder 184 lie against the partial zones 124, 128 and thus receive guidance.

According to whether the handle 37 is hinged in the one or the other direction, the edges 189, 191 of the handle web 183 are in abutment in the partial zones 123, 127; 126, 129, as shown for example by FIG. 16. The under side, visible in FIG. 14, of the handle web 183 is the under side in the closed condition according to FIG. 19, and is ribbed to save weight. The handle web 183 extends for example according to FIG. 19 a distance beyond the 25° slope 113 and then merges with an angle 192 of 25° into the handle grip 185. Its upper side 193 lies in the upper side 23 in the closed condition. Laterally the handle grip 185 protrudes beyond the edges 189, 191 and has three recesses 194, 196, 197, from beneath. The recesses 194, 197 here lie so that (FIG. 19) they receive the upper part in FIG. 2 of the walls 61, 62. The walls 199, 201, since they likewise have a perpendicular course, here lie on the inner surfaces of the walls 61, 62. For arresting, the walls 61, 62 inwardly and upwardly have two nipples 202 directed towards one another, which can engage in depressions 203 of the webs formed by the recesses 194, 196, 197. So that the depressions 203 can be produced easily, a bore 204 is provided in alignment with them in the outer webs.

Figure 19:
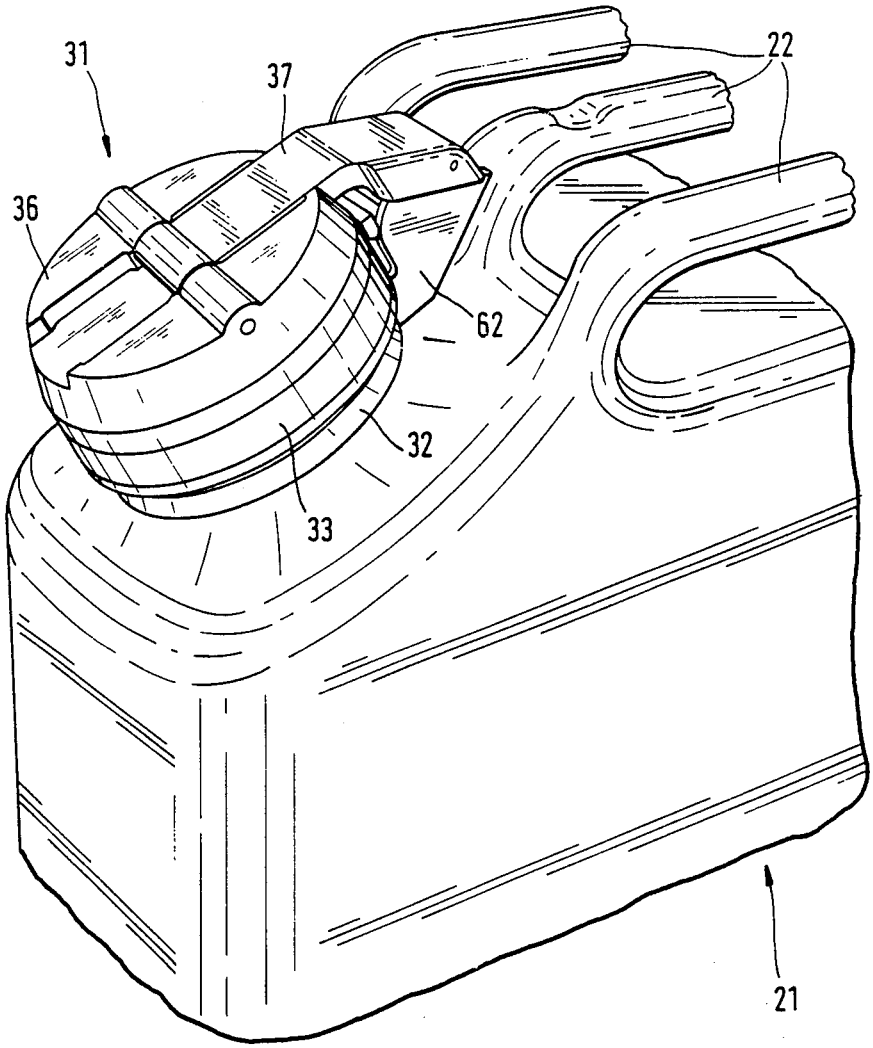
FIG. 19 shows a perspective view of the stopper in the closure position.

If from the initial position according to FIG. 19 it is intended to open the fitted and closed stopper, then the engagement by the nipples 202 and the depression 203 is overcome, the handle 37 is hinged down through 180° until it again lies in the groove 116, and now the handle 37 is rotated until the stop face 112 abuts on the wall 62. Then the cap 36 can be raised and brought for example into the positions as shown in FIG. 17 or FIG. 18.

Closing proceeds in the exactly converse manner.

What is claimed is:

1. Screw stopper for synthetic plastic cans in the range of 10 liters and above, comprising:

a pouring spout which is rigidly connected with said synthetic plastic can, said pouring spout having a geometric longitudinal axis, an external threading, and an end face with an annular seal thereon, a cap for said pouring spout, which is rotatable between a closed position and an open position, said cap having an external circumference and an internal threading fitting said external threading on said pouring spout, a projecting device projecting from said external circumference of said cap for manual transmission of a torque, a connectin device between said pouring spout and said cap, which makes said cap non-loseable and permits rotation of said cap in relation to said pouring spout, and the improvement wherein:

(a) said external threading is provided in three or more sectors in relation to said geometrical longitudinal axis of said pouring spout, (b) said internal threading is provided in three or more sectors in relation to said geometrical longitudinal axis of said pouring spout, with said internal threading sectors fitting in circumferential angle into said external threading sectors and vice versa, (c) said internal and external threadings have equal pitch, which pitch is high enough that rotation of said cap through 180 degrees plus/minus 30 derees rotates said cap from said closed position to said open position and vice versa, (d) said cap has an upper side and said projecting device comprises a handle on said upper side of said cap, said handle being provided with a handle grip that protrudes far beyond said external circumference of said cap and a handle web with an end region pivotably articulated with said cap, (e) said connection device includes a retaining ring which guides said cap in a shape-engaging manner and a guide device that is rigidly connected with said pouring spout and guides said retaining ring substantially nonrotatably in relation to said geometrical longitudinal axis, and (f) said guide device has a partial region arranged as an arrestor for said handle grip in said closed position of said cap.

2. Screw stopper according to claim 1, wherein three sectors of said external threading and said internal threading are provided, and rotation of said cap through 180 degrees rotates said cap between said closed and open positions.

3. Screw stopper according to claim 1, wherein said sectors of said external threading are of equal length and arranged at angularly regular intervals.

4. Screw stopper according to claim 2, wherein said sectors are longer than 45 degrees and shorter than 60 degrees.

5. Screw stopper according to claim 1, wherein said can has a spout extension integral with said can, and said external threading is part of an annular, injection-molded body which firmly and rigidly-abuttingly girdles said spout extension.

6. Screw stopper according to claim 1, wherein said cap is injection-molded from synthetic plastic.

7. Screw stopper according to claim 1, wherein said connection device is injection-molded from synthetic plastic.

8. Screw stopper according to claim 1, wherein said handle web has a width of at least one fifth of the external diameter of said cap.

9. Screw stopper according to claim 1, wherein said handle web has a width 3.5 plus/minus 15% smaller than the external diameter of said cap.

10. Screw stopper according to claim 1, wherein said handle web is flat in relation to its width.

11. Screw stopper according to claim 1, wherein said cap has a transverse axis and said handle web has a free end zone that is pivotable through 180 degrees about said transverse axis.

12. Screw stopper according to claim 11, wherein perpendicularly of said transverse axis, said upper side of said cap has a shallow groove that accommodates said handle web in width and height.

13. Screw stopper according to claim 12, wherein said handle web has side faces and said groove has side walls, and, at least in partial zones, said side faces of said handle web rest on said side walls of said groove.

14. Screw stopper according to claim 1, wherein said can has carrying handles with upper sides and said handle grip has an upper side that, in a closed condition, lies at the level of said upper sides of said carrying handles and is angled in relation to said handle web.

15. Screw stopper according to claim 1, wherein said handle grip has a hollow portion on its under side, which engages said partial region of said guide device.

16. Screw stopper according to claim 15, wherein said partial region of said guide device is also a security means against rotation for said handle grip.

17. Screw stopper according to claim 1, wherein when said guide device has webs, and when said handle grip is arrested by said guide device, it sits against said webs.

18. Screw stopper according to claim 1, wherein said retaining ring has a shank zone, and said guide device comprises two mutually parallel, mutually spaced, walls parallel to said geometrical longitudinal axis of said pouring spout, said walls having interior machined depressions that guide said shank zone between them.

19. Screw stopper according to claim 18, wherein said shank zone comprises two lugs bent out of said retaining ring and guided on said parallel walls of said guide device.

20. Screw stopper according to claim 19, wherein a distance piece is provided which provides a spacing member for said lugs and grasps around said lugs.

21. Screw stopper according to claim 1, wherein said retaining ring has a flat profile in cross-section and is circular-cylindrical, and said external circumference of said cap has a matching groove in which said retaining ring is guided.

22. Screw stopper according to claim 1, wherein on said external circumference of said cap, at least one projection is provided which abuts said guide device in said closed position and/or said open position.

23. Screw stopper according to claim 22, wherein said projection is provided beneath said retaining ring.

* * * * *